US009525938B2

(12) United States Patent
Deshpande et al.

(10) Patent No.: US 9,525,938 B2
(45) Date of Patent: Dec. 20, 2016

(54) USER VOICE LOCATION ESTIMATION FOR ADJUSTING PORTABLE DEVICE BEAMFORMING SETTINGS

(71) Applicant: Apple Inc., Cupertino, CA (US)

(72) Inventors: Ashrith Deshpande, San Jose, CA (US); Andrew P. Bright, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 401 days.

(21) Appl. No.: 13/838,213

(22) Filed: Mar. 15, 2013

(65) Prior Publication Data

US 2014/0219471 A1 Aug. 7, 2014

Related U.S. Application Data

(60) Provisional application No. 61/761,485, filed on Feb. 6, 2013.

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01); *H04R 2499/11* (2013.01)

(58) Field of Classification Search
None
See application file for complete search history.

(56) References Cited

U.S. PATENT DOCUMENTS

| | | | | |
|---|---|---|---|---|
| 7,415,117 | B2 | 8/2008 | Tashev et al. | |
| 7,672,196 | B1 | 3/2010 | Hanyu | |
| 8,204,248 | B2 | 6/2012 | Haulick et al. | |
| 8,300,845 | B2 * | 10/2012 | Zurek et al. | 381/92 |
| 8,428,661 | B2 * | 4/2013 | Chen | 455/570 |
| 2003/0044025 | A1 * | 3/2003 | Ouyang et al. | 381/92 |
| 2008/0170716 | A1 * | 7/2008 | Zhang | H04R 3/005 381/92 |
| 2012/0019689 | A1 | 1/2012 | Zurek et al. | |
| 2012/0020485 | A1 | 1/2012 | Visser et al. | |
| 2012/0182429 | A1 * | 7/2012 | Forutanpour | H04R 3/005 348/175 |
| 2013/0329908 | A1 | 12/2013 | Lindahl et al. | |

* cited by examiner

*Primary Examiner* — Curtis Kuntz
*Assistant Examiner* — Kenny Truong
(74) *Attorney, Agent, or Firm* — Blakely, Sokoloff, Taylor & Zafman LLP

(57) ABSTRACT

An audio device may use the audio detected at two opposite facing, front and rear omnidirectional microphones to determine the angular directional location of a user's voice while the device in speaker mode or audio command input mode. The angular directional location may be determined to be at front, side and rear locations of the device during the period of time by calculating an energy ratio of audio signals output by the front and rear microphones during the period. Comparing the ratio to experimental data for sound received from different directions around the device may provide the location of the user's voice. Based on the determination, audio beamforming input settings may be adjusted for user voice beamforming. As a result, the device can perform better beamforming to combine the signals captured by the microphones and generate a single output that isolates the user's voice from background noise.

19 Claims, 9 Drawing Sheets

USER VOICE LOCATION ESTIMATION FOR ADJUSTING PORTABLE DEVICE BEAMFORMING SETTINGS

This application is a non provisional of U.S. Provisional Patent Application No. 61/761,485 filed Feb. 6, 2013 entitled "USER VOICE LOCATION ESTIMATION FOR ADJUSTING PORTABLE DEVICE BEAMFORM SETTINGS".

FIELD

Embodiments of the invention relate to portable electronic audio devices and comparing the audio detected at a front and rear microphone of the device to determine the angular location of a user's voice around a total spherical perimeter of the device. Based on the determination, audio beamforming input settings may be selected or adjusted to provide better beamforming for the user's voice. Other embodiments are also described.

BACKGROUND

Portable audio devices such as consumer electronic audio devices or systems including tablet computers, smart phones, cellular phones, mobile phones, digital media players and the like may use more than one acoustic microphone to receive or input audio from the user's mouth (e.g., a user's voice). In some case, the device may have at least two opposite facing acoustic microphones on opposing surfaces (faces) of the device.

An audio integrated circuit referred to as an audio codec may be used within the audio device, to receive audio signals from multiple integrated microphones of the device, such as during "speakerphone mode". In addition, the audio codec also includes the capability of outputting audio to one or more speakers of the device. The audio codec is typically equipped with several such audio input and output channels, allowing audio to be played back through any of the speakers and received from any of the microphones.

However, under typical end-user or environmental conditions, a single microphone may do a poor job of capturing a sound of interest (e.g., speech received from a user's mouth) due to the presence of various background sounds. So, to address this issue many audio devices often rely on noise reduction, suppression, and/or cancelation techniques. One commonly used technique to improve signal to noise ratio is audio beamforming. Audio beamforming (also referred to as spatial filtering) is a digital signal processing technique in which sounds received from two or more microphones are processed and combined to enable the preferential capture of sound coming from certain directions. For example, a computing device can form beampattern using two or more closely spaced, omnidirectional microphones linked to a processor. The processor combines the signals captured by the different microphones to generate a single output to isolate a designed sound source from background noise. Such beamforming may be used to more accurately detect a user's voice while in speaker mode.

SUMMARY

Embodiments of the invention include a portable electronic device (e.g., mobile phone) generating a front microphone signal from (e.g., responsive to) detection of a user's voice at a front microphone located at a front surface of the device. This may include detecting the voice over, or during, a period of time, such as a period during speakerphone use or voice activated commands use of the device. It may also include filtering the microphone signal to detect frequencies for human speech. During the same period the device generates a rear microphone signal from detection of the user's voice at a rear microphone which is located at a rear surface of the portable electronic device.

During the period, the user may move or hold the device at different angles or in different modes with respect to the location of the user's mouth. From the device's perspective, this may cause the user's mouth to move horizontally and/or vertically around a spherical perimeter of the device. By comparing the front microphone signal to the rear microphone signal, the device can determine the angular directional locations of the user's mouth or origination or source of user's voice, during the period of time.

Comparing the front microphone signal to the rear microphone signal may include calculating an energy ratio of the front beam to the rear beam signal, such as by subtracting a rear beam energy or power units of in dB from that of the frontbeam. For example, higher positive energy ratio levels will result when the user's voice is received from a front location above the front microphone (e.g., front angles near 0 degrees with respect to a +Z axis through the X, Y axis of the front surface of the device); near zero energy ratio levels will result when the user's voice is received from a side location near sides of the device (e.g., left side, right side, bottom or top such as any of omni direction angles near 90 and 270 degrees, such as along the X, Y axis); and higher negative energy ratio levels will result when the user's voice is received from a rear location below the rear microphone (e.g., rear angles near 180 degrees, such as corresponding to a −Z axis through the X, Y axis of the front surface of the device). The calculated energy ratio can be compared with experimental data gathered for sound received by such a device from different directions around the device perimeter, to provide an estimate of the angular directional location of the user's voice. Thus, the user's voice can be better located at any angular location of a complete spherical perimeter around the device (e.g., all angles theta and phi in spherical coordinates).

Based on the determined angular locations, the device can provide better audio beamformer angular directional tuning inputs of the front and rear microphones (e.g., when processing microphone beamformer signals) during the period of time. This may include selecting between a front beam, an omni beam, and a rear beam pattern for selecting beamforming input data. It can also better change beamformer angular tuning aggressiveness of the front and rear microphones during the period of time. Thus, better audio beamformer angular directional tuning can be performed for the user's voice located at any angular location of the complete spherical perimeter around the device. This better captures the user's voice from the user's angular location, as opposed to noise at other angles around the entire spherical perimeter.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Embodiments of the invention relate to performing user voice location estimation at any angular location of a complete spherical perimeter around a portable device the user is holding; and, based on that location, adjusting portable device beamforming settings around that perimeter to better detect the user's voice. For example, embodiments provide processes, devices and systems for using the audio detected at two opposite facing (e.g., front and rear facing) omnidirectional microphones to determine the angular directional location of a user's voice (e.g., while in speaker mode or audio command input mode). Based on the determination, audio beamforming input settings may be selected or adjusted, such as for user voice beamforming data input. As a result, the device (e.g., a processor linked to the microphones) can perform better beamforming to combine the signals captured by the different microphones to generate a single output that isolates the user's voice from background noise (e.g., while in speaker mode).

Figure 1B:
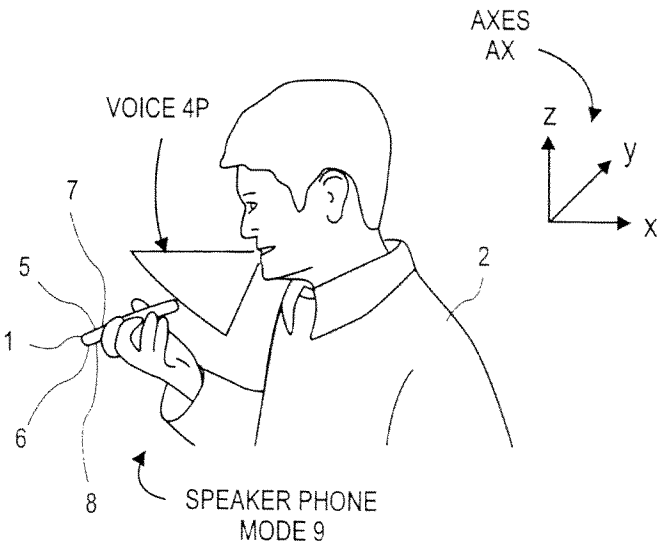
FIG. 1B shows a portable audio device in use while in the "speaker phone" mode.
Figure 1A:
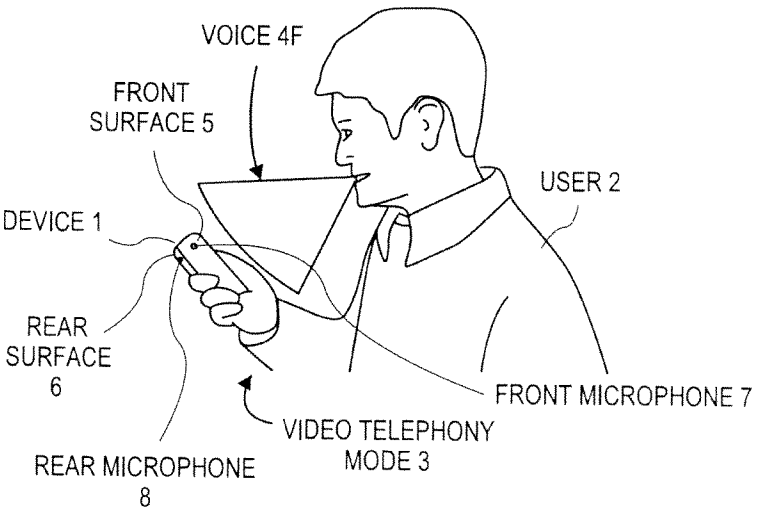
FIG. 1A shows a portable audio device in use while in "video telephony" mode.

FIG. 1A shows a portable audio device in use while in "video telephony" mode. FIG. 1A shows portable audio device 1 being used by user 2 in "video telephony" mode 3. In this mode front face or surface 5 may be oriented towards the user's mouth, such as where the user's mouth is tangential to and pointing at a planar surface of the front face. In this mode the user's voice 4F is shown primarily incident from a front location, upon front surface 5 having front microphone 7. In this mode the device may or may not be taking video or images using a camera, but may have one or more microphones receiving the user's voice, such as during speakerphone use or voice activated commands use of the device. Rear surface 6 includes rear microphone 8. Surface 5 may be a front face of the device and surface 6 may be a rear face of the device.

FIG. 1B shows a portable audio device in use while in the "speaker phone" mode. FIG. 1B shows device 1 being used in "speaker phone" mode 9. In this mode bottom surface of the device may be oriented towards the user's mouth, such as where the user's mouth is parallel to and pointing along a planar surface of the front or rear face. In this case the user's voice 4P is incident from a side location, primarily upon a side surface, or the bottom surface of the device. In some cases, side locations include all of the left side, right side, bottom and top locations of the device. Thus, a side location may be any of the left side, right side, bottom or top location of the device. In this mode the device may or may not be being used as a speaker phone, but may have one or more microphones receiving the user's voice, such as during speakerphone use or voice activated commands use of the device.

Embodiments of the descriptions herein may be applicable to the modes shown in FIGS. 1A-B as well as others. For example the descriptions may be applicable to cases where the device does not received information or a cue from the video that identifies or provides information about the location of the user. For example, the descriptions may apply when the device is in speakerphone mode, SIRI (e.g., voice command mode), etc. In one embodiment, the descriptions may apply in those modes, but may not be used when the device is in a Facetime type of video call application.

In some embodiments the user or user's mouth is at a distance of at least twice the acoustic spacing between microphones 7 and 8. In some cases, this distance may be described as being in "far-field" with respect to the microphone array (e.g., microphones 7 and 8). In some cases, twice the acoustic spacing between the microphones maybe defined as the direct measured distance from the acoustic input (edge or center) of microphone 7 to that of microphone 8. In other cases the distance maybe along a plane of surface 5 or 6 from the acoustic inputs of the microphones.

For example, over a period of time, the user may move the device to, or hold the device at different angles or in different modes with respect to the location of the user's mouth or voice. In some cases, device 1 may be turned or rotated about itself in the X-Y plane of axes AX, relative to the user's voice (e.g., source of the user's voice) which has remained essentially fixed. Thus, surfaces 5 and 6, and microphones 7 and 8 may be moving relative to the user's voice. From the perspective of the device, this may cause the user's voice to move from or between front, side and rear locations with respect to the device. Such movement may be horizontally and/or vertically around a spherical perimeter of the device, with respect to the surfaces and microphones. During this time, audio detected at the microphones can be used to determine the angular directional location of a user's voice (e.g., a source of the voice, such as the user's mouth) relative to the device.

Descriptions herein will generally refer to the front face of device 1 as corresponding to front surface 5 as shown; the rear face of device 1 corresponding to rear surface 6; and the side faces or surfaces of device 1 corresponding to the thinner, left, right, top, and bottom surfaces of device 1. It can be appreciated that other term or labels may be used for these surfaces. Device 1 may be a generally planar portable device having front surface 5 and an opposing rear surface 6 which are both generally planar.

Device 1 may represent a portable audio device or a handheld electronic device such as consumer electronic audio devices including pad computers, smart phones, cellular phones, mobile phones, digital media players and any other device having at least two microphones. The device may have a cell phone, radio, and/or WiFi transceiver.

Figure 2A:
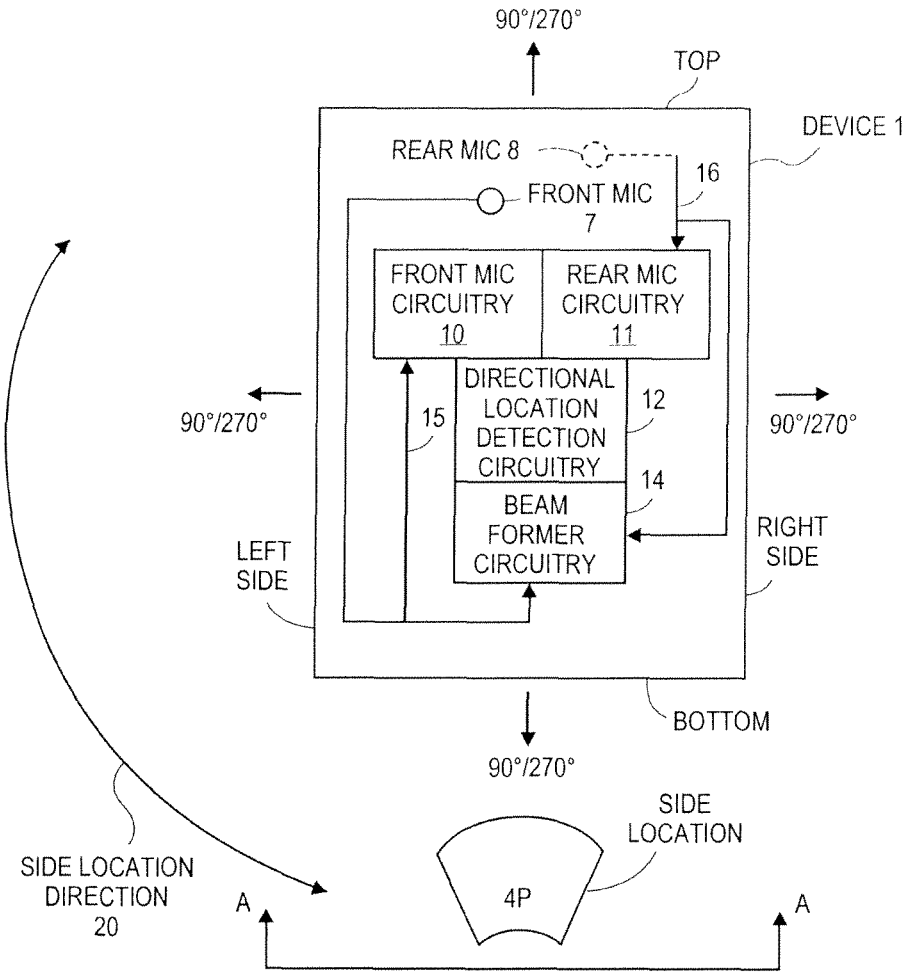
FIG. 2A shows a top perspective cross-section and block diagram of relevant portions of the portable audio device for performing user voice location estimation and adjusting portable device beamforming settings based on that location.

Microphone 7 may be located on generally planar front surface 5 of portable device 1. The device may have a touchscreen input (e.g., see touchscreen 76 of FIG. 8) on front surface 5. Microphone 8 may be located on generally planar rear surface 6 of portable device 1. Microphones 7 and 8 may represent integrated microphones, such as microphones that are part of device 1, and are electronically connected to provide their audio output signals (e.g., signals 15 and 16 as shown in FIG. 2A) to circuitry of device 1. In some cases, microphones 7 and 8 are microphones located on, under, or just below the front and rear surfaces.

Microphones 7 and 8 may be oriented to have their acoustic inputs facing opposite directions (e.g., facing diametrically or 180 degree opposed directions). In some cases the microphones are two opposite facing microphones on opposing surfaces of the device. The microphones may be on opposing surfaces of the device, diametrically opposed, or facing outward 180 degrees from each other.

Microphones 7 and 8 may represent microphones that are acoustic microphones that use a diaphragm to sense sound pressure in or traveling through air. The microphones may sense sound by being exposed to outside ambient. Microphones 7 and 8 may be exposed to the ambient or may have a microphone "boot" between them and the ambient air.

The microphones may be cardioid type microphones or have cardioid type microphone sensitivities. The microphones may include filtering or have input audio characteristics to detect frequencies for human speech. In some cases, the front and rear microphones produce microphone signals that are each cardioid signals 15 and 16; and that are bandpass filtered in a range between 0.1 kHz and 7 kHz. The microphones may receive audio input from the user's mouth, such as the user's speech or voice when the user is speaking and holding the device.

In some embodiments, Microphone 7 or microphone 8 may represent more than one microphone, such as by each representing a microphone array. These additional microphones may be considered a part of microphones 7 and 8 if they are oriented to have their acoustic inputs in directions parallel to those of microphones 7 and 8.

It is also considered that microphones in addition to microphones 7 and 8 may be integrated into or exist on device 1. In some cases, microphones that do not have their acoustic inputs in directions parallel to microphones 7 and 8 are not considered in the descriptions herein. For example, device 1 may have one or more microphones having their acoustic inputs oriented outwards from the bottom surface of the device, such as microphones located at device's receiver opening on the bottom surface (e.g., see microphone 79 of FIG. 8) or microphones used to detect a user's voice when device 1 is being held up to the users ear (e.g. during a telephone call). In other cases, microphone 7 may be located in the device's receiver opening.

For additional embodiments, the concepts herein may be expanded to apply where device 1 uses 3, 4 or more differently oriented microphones for performing user voice location estimation and adjusting portable device beamforming settings based on that location.

Figure 2B:
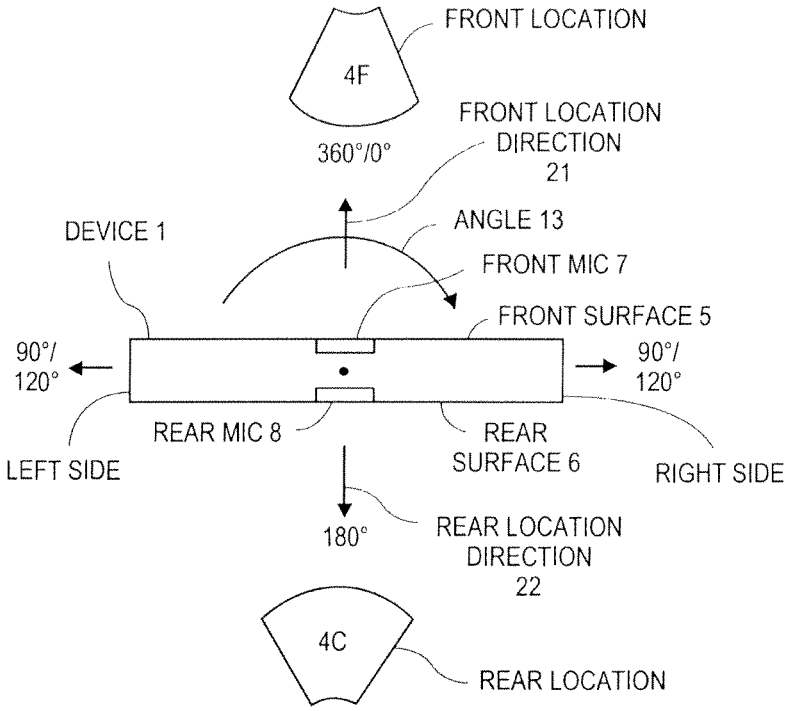
FIG. 2B show a bottom perspective cross-section and block diagram of FIG. 2A through perspective "A".
Figure 2C:
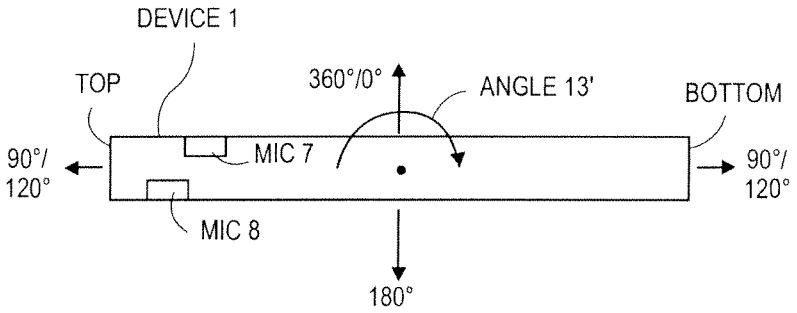
FIG. 2C shows aloft side perspective cross-section and block diagram of FIG. 2A through a perspective perpendicular to perspective "A".

FIG. 2A shows a top perspective cross-section and block diagram and circuit schematic of relevant portions of the portable audio device for performing user voice location estimation and adjusting portable device beamforming settings based on that location. FIG. 2B show a bottom perspective cross-section and block diagram of FIG. 2A through perspective "A". FIG. 2C shows a left side perspective cross-section and block diagram of FIG. 2A through a perspective perpendicular to perspective "A".

FIG. 2A shows device 1 including front microphone 7 and rear microphone 8. Although the microphones are shown at certain locations in the figures, it can be appreciated that various other locations on surfaces 5 and 6 are also possible, where the microphones inputs are oriented in opposite directions.

FIG. 2A shows device 1 sending a front microphone signal 15 through a connection or wire to front microphone circuitry 10 and beam former circuitry 14. It also shows device 1 sending a rear microphone signal 16 through connection or wire to rear microphone circuitry 11 and beam former circuitry 14. It can be appreciated that wires for signals 15 and 16 may represent electronic connections such as wires, traces, lines, circuitry, and the like as known in the art for transmitting a microphone output signal (e.g. audio signal) to circuitry of the device.

In some cases, microphone 7 may have front microphone circuitry to generate front microphone signal 15 from detection of a user's voice at front microphone 7 located at on front surface 5 of a portable electronic device 1 during a period of time. In some cases, microphone 8 may have rear microphone circuitry to generate a rear microphone signal 16 from detection of the same user's voice at rear microphone 8 located at on rear surface 6 of a portable electronic device 1 during the same period of time. Circuitry 10 and 11 may be described as circuitry for detecting a user's voice at a front and rear microphone during the same period of time, as described herein.

Circuitry 10 and 11 are connected to directional location detection circuitry 12. Circuitry 12 may also be described as circuitry for user voice location estimation or detecting the location of a user's voice with respect to angle 13 as shown in FIGS. 2A and B. Angle 13 may be an angle originating at the center of microphone 7 (or surface 5), pointing straight up at 0 degrees, and increasing in angle from left to right side of device 1 (or optionally increasing in the opposite direction). Circuitry 12 may also be described as circuitry for user voice location estimation as described herein, such as by comparing the front microphone signal to the rear microphone signal to determine at least one angular directional location of the user's voice during the period of time. In some cases, circuitry 12 includes signal processing circuitry to calculate an energy ratio of the front microphone signal to the rear microphone signal to determine at least two angular directional locations of the user's voice during a period of time.

For example, FIG. 2A shows device 1 having front and rear surfaces 5 and 6 parallel to the plane of FIG. 2A. In this case, angle 13 is approximately 90° or 270° along the plane of FIG. 2A (e.g. the paper upon which FIG. 2A is drawn). This angle may be described as a side location direction 20 with respect to the device and may also be represented by perspective "A". In some cases, side location directions include all of the left side, right side, bottom and top direction of the device. Thus, a side location direction may be any of the left side, right side, bottom or top directions of the device.

Figure 6:
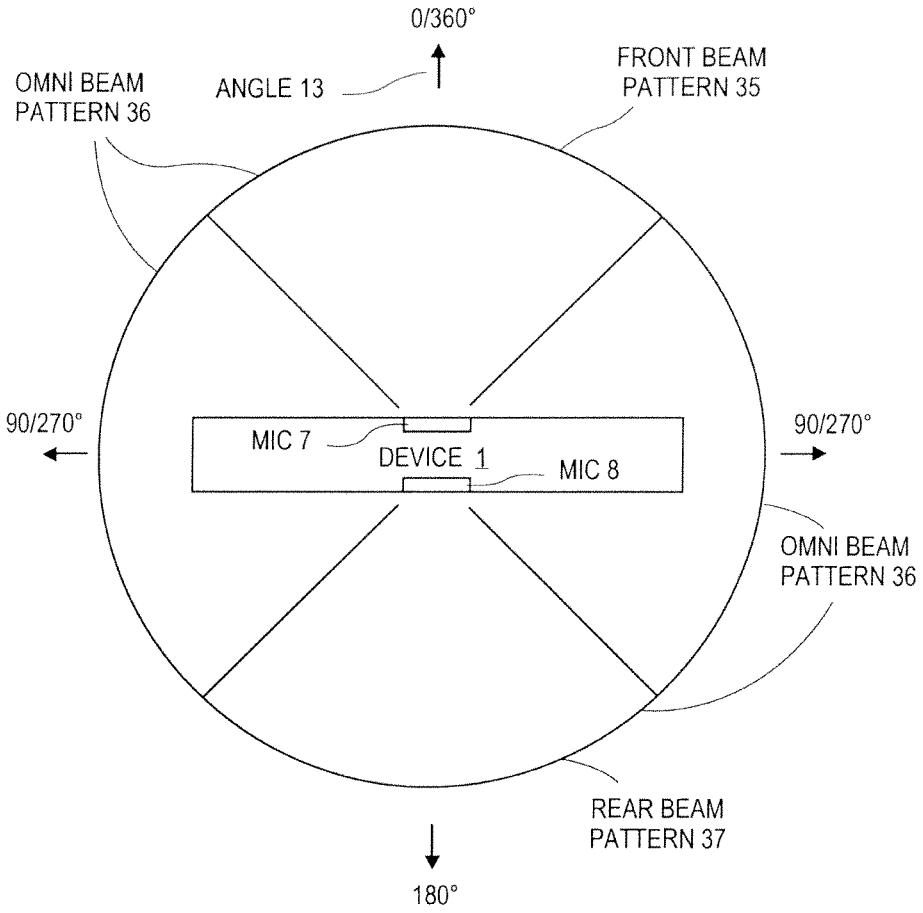
FIG. 6 shows an example of front, omni and rear beam patterns of a portable audio device.
Figure 7:
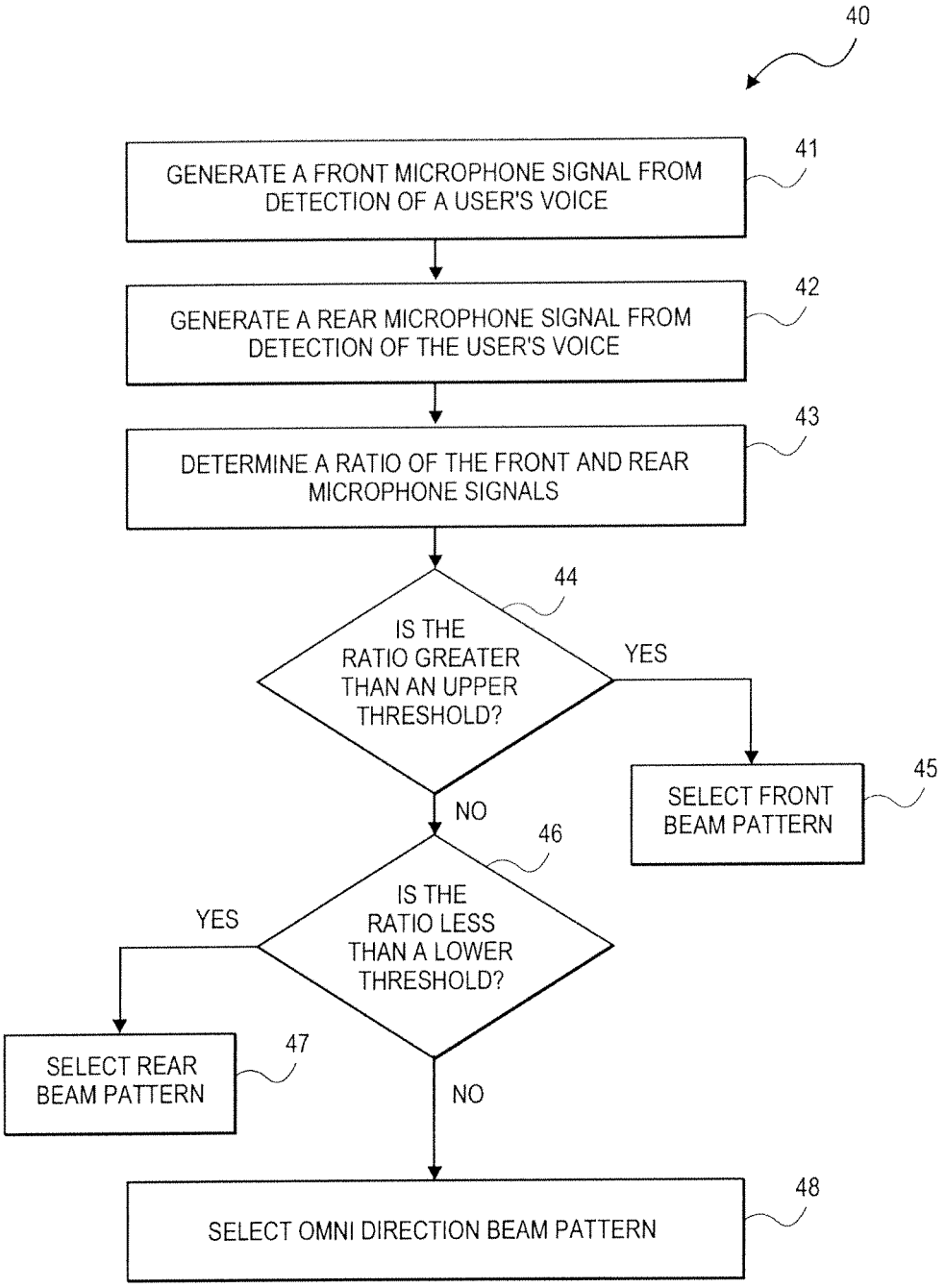
FIG. 7 is a flow diagram of an example process for performing user voice location estimation and adjusting portable device beamforming settings based on that location.

According to embodiments, circuitry 12 may be used to perform user voice location estimation and circuitry 14 may be used to perform adjusting portable device beamforming settings based on that location, as noted herein (e.g., see FIGS. 6 and 7). Beamformer circuitry 14 may also be described as circuitry for changing beamformer directional tuning of the front and rear microphones (and optionally others) during the period of time based on the angular directional location of the user's voice that is detected. In some cases, circuitry 14 includes beamformer angular directional tuning circuitry to change beamformer directional tuning of the front and rear microphones between at least two of a front beam pattern, an omnidirectional pattern, and a rear beam pattern during the period of time (or a longer time period), based on two detected angular directional locations of the user's voice.

FIG. 2A shows user voice 4P incident upon device 1 from a "side location", such as from angle 13 of 90° or 270°. In this case, voice 4P may represent voice 4P as shown in FIG. 1B, such as where the device is in speaker phone mode 9. Side location direction 20 and angles 13 of 90° or 270° might describe the XY plane in Cartesian coordinates, such as a plane corresponding to the front surface 5.

FIG. 2B shows angle 13 having 360° or 0° in front location direction 21 and 180 in rear location direction 22. Direction 21 may represent that Z+ direction, direction 22 may represent the Z− direction, and angles of 90° or 270° (e.g., side direction 20) may represent the XY plane. FIG. 2B shows user voice 4F incident upon device 1 from a "front location", such as from angle 13 of 0°. Voice 4F may represent voice 4F of FIG. 1A, such as where the device is in FaceTime mode 3.

FIG. 2B also shows voice 4C incident upon device 1 from a "rear location", such as from angle 13 of 180°. This may be when the device has the user's voice incident upon rear surface 6. This may be an instance similar to FIG. 1A where device 1 is flipped over so that rear surface 6 is facing the user.

FIG. 2C shows angle 13', which may represent an angle orthogonal to that of angle 13 shown in FIG. 2B. For example, FIG. 2C shows angle 13' oriented towards the top and bottom surface of device 1. Angle 13' may be an angle originating at the center of microphone 7 (or surface 5), pointing straight up at 0 degrees, and increasing in angle from top to bottom of device 1 (or optionally increasing in the opposite direction). For some of the embodiments described herein, the descriptions regarding angle 13', polar coordinate angles (e.g., theta), angular locations of the user's voice, directional angles, or other angles may apply to angle 13. In some cases, they may apply to angle 13'. In some cases they may apply to angles 13 and 13'. Thus, the user's voice can be better located at any angular location (e.g., at all locations) of or in a spherical perimeter around the device.

Notably, in some cases, the user's voice can be better located at any angular location over a period of time while the user moves or holds the device at different angles or in different modes (including those shown in FIGS. 1-2) with respect to the location of the user's voice or mouth. From the perspective of the device, these locations are of the user's voice while it moves horizontally and/or vertically around a spherical perimeter of the device, with respect to the front surface (e.g., even though the user's mouth may be at an essentially fixed location and the device is being moved, turned or rotated with respect to axes AX).

These locations of the user's voice, and the perimeter may also be represented by angles in spherical coordinates. For example, polar angle (theta) may correspond to the +Z direction (e.g., 0° in front direction 21 is 0 degrees theta); and azimuthal angle (phi) may correspond to angles in the X, Y plane of the front (or rear surface) where Z=0, such as described for FIGS. 2-6. Radial distance r may not be relevant.

In some embodiments, theta or phi can not be practically estimate in regular usage. In these cases, the locations detection patterns (e.g., front, rear and side) are symmetrical around the device in the +Z and XY planes.

Some embodiments of the invention perform user voice location estimation and adjust portable handheld device beamforming settings based on that location for a user's voice while in speaker mode or audio command input mode. Some embodiments apply for a user's voice while in a mode expecting that the angular location of the user's voice will change. Some embodiments do not apply for a user's voice while in handset, headset or headphone mode. Some embodiments do not apply for a user's voice while in a mode expecting that the angular location of the user's voice will not change.

Figure 3:
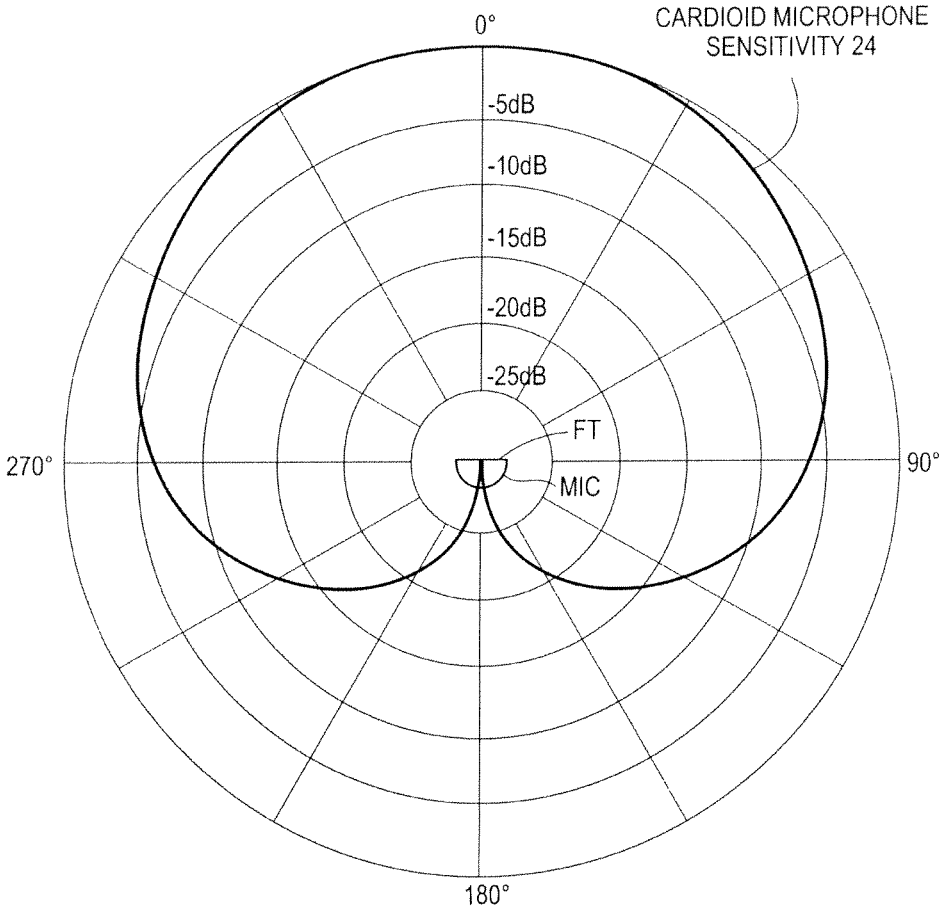
FIG. 3 shows a polar plot example of cardioid microphone sensitivity.

FIG. 3 shows a polar plot example of cardioid microphone sensitivity. FIG. 3 shows cardioid microphone sensitivity 24 with respect to polar coordinates (e.g., polar angle theta) or microphone MIC having front surface FT facing angle 13 of 0 degrees (e.g., the +Z axis). Sensitivity 24 may be described as the directional characteristic or directional response of a cardioid microphone. FIG. 3 may represent the response of microphones 7 and 8 with respect to their front surfaces. Microphone 7 may have its front surface facing at angle 0° of angle 13, and microphone 8 may have its front surface facing at angle 180° (e.g. rear direction 22) of angle 13. Sensitivity 24 may represent a three dimensional sensitivity of the microphones with respect to the direction they are facing (e.g., polar angle (theta)). In some cases, sensitivity 24 may represent a sensitivity that includes frequencies of data that represent vibration at a frequency typical for a user's speech.

Figure 4A:
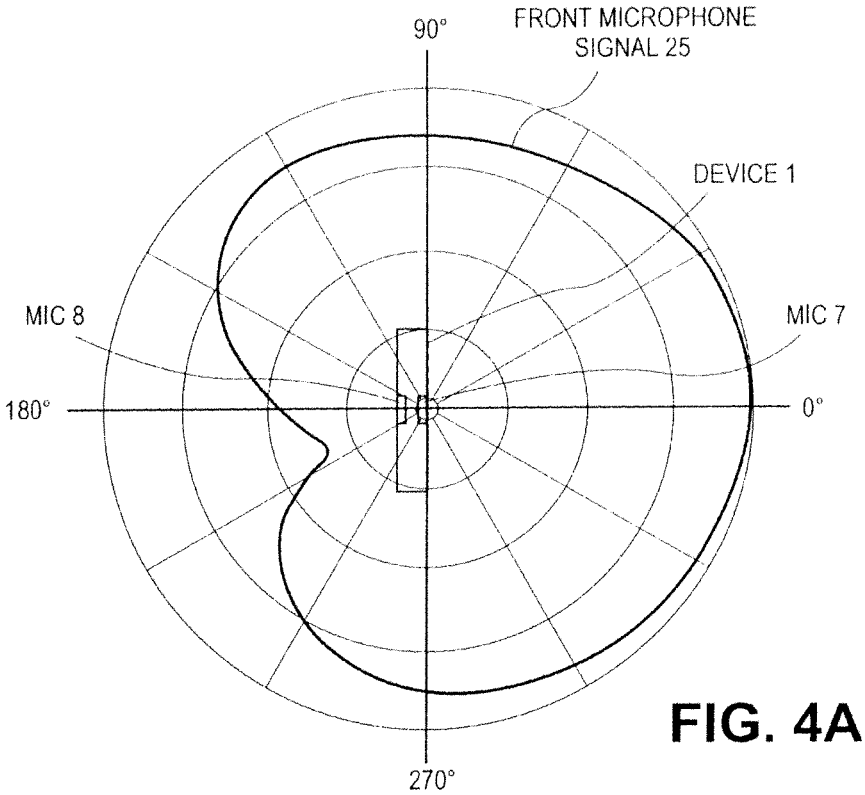
FIG. 4A shows a polar plot example of experimental data of a front microphone signal of a front microphone of a portable audio device.
Figure 4B:
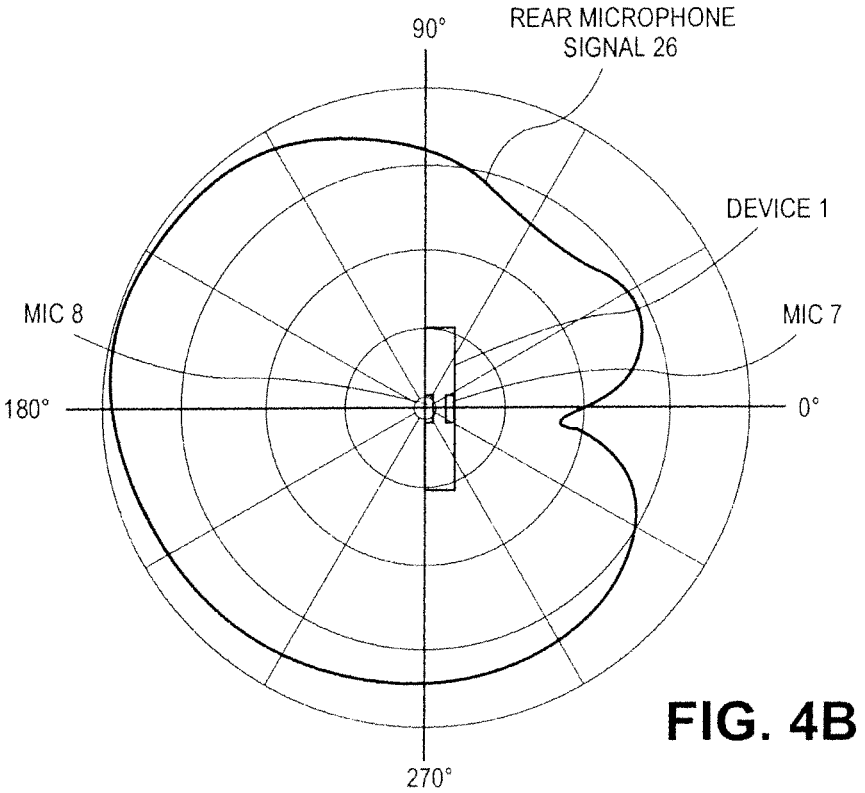
FIG. 4B shows a polar plot example of experimental data of a rear microphone signal of a rear microphone of a portable audio device.

FIG. 4A shows a polar plot example of experimental data of a front microphone signal of a front microphone of a portable audio device. FIG. 4B shows a polar plot example of experimental data of a rear microphone signal of a rear microphone of a portable audio device. FIG. 4A shows experimental data representing the front microphone test signal 25 output by microphone 7 for sound received at different angles 13 with respect to device 1, where 0 degrees represents angle 13 of 0 degrees (e.g., the +Z axis). Signals 25 and 26 may be with respect to angle 13 shown in FIG. 2B, such as where 90° of FIGS. 4A and B represent the left side of the device and 270° represent the right side of the device. FIG. 4B shows experimental data representing the rear microphone test signal 26 output by microphone 8 for sound received at different angles 13 with respect to device 1, where 0 degrees represents angle 13 of 0 degrees (e.g., the +Z axis). In some cases, signals 25 and 26 may represent signals that include frequencies of data that represent vibration at a frequency typical for a user's speech.

Signals 25 and 26 may represent experimental data for a frequency or range of frequencies tested for device 1. In some cases, they may represent the frequency of 5 kHZ tested by a response of the microphones to a "chirp" in a test setting. The test setting may have been in a normal ambient or room, in an anechoic chamber, or in a noisy environment. In some cases, signals 25 and 26 represent the test results for an average of a range of frequencies, such as frequencies between 0.1 kHZ and 7 kHZ.

Thus, in some cases, signal 25 may represent a response expected for a user's voice where the response for microphone 7 is at a maximum at 0° (e.g. FIG. 1A or voice 4F of FIG. 2B), and is at a minimum near 180°. Signal 26 may be near or at a maximum at 180° (e.g. receiving voice 4C as shown in FIG. 2B), but at a minimum at 0° (FIG. 1A or voice 4F of FIG. 2B). Signals 25 and 26 may be approximately equal at 90° and 270° (e.g. the situation shown in FIG. 1B or voice 4P shown in FIG. 2A). Consequently, it is possible to make an estimation of the location or angular direction of sound with respect to microphones 7 and 8 by considering signals 15 and 16 from microphones 7 and 8, as compared to test signals 25 and 26. It is noted that signals 25 and 26 may apply to cases, side locations are tested (e.g., at 90 and 270 degrees) that include all of the left side, right side, bottom and top locations of the device. Thus, a side location direction estimation may be at any of the left side, right side, bottom or top location of the device.

Figure 5:
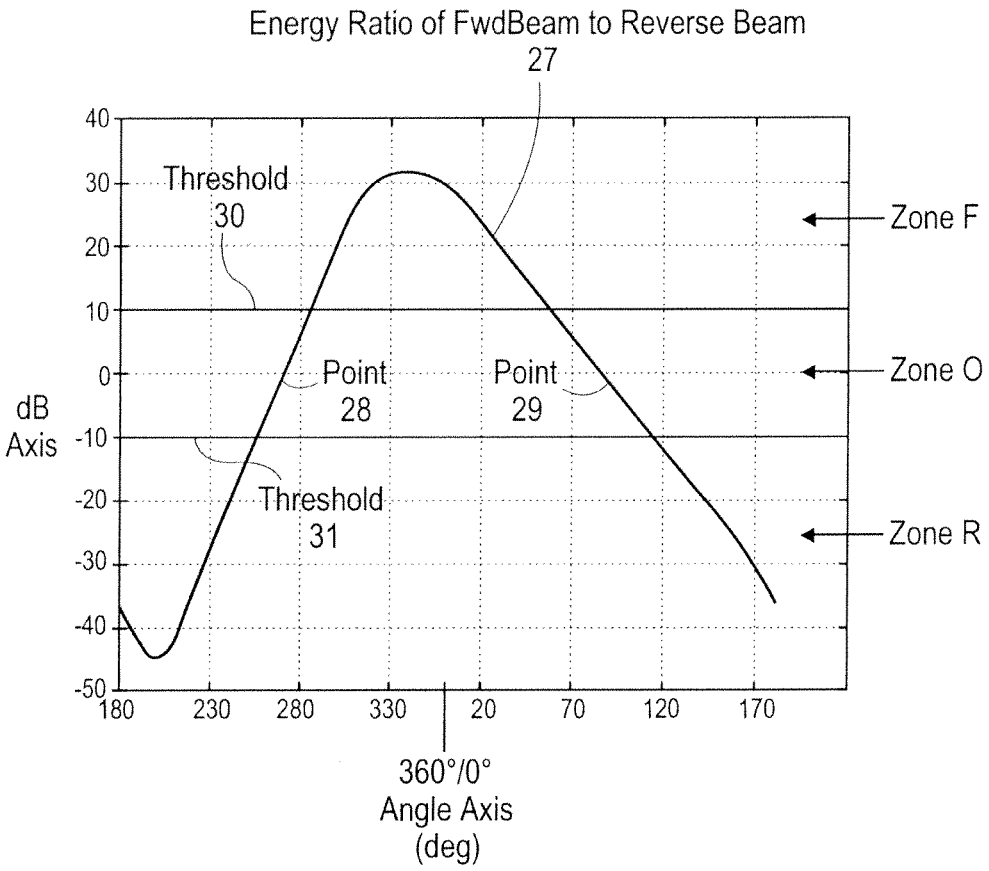
FIG. 5 shows a plot example of experimental data of an energy ratio of a front microphone signal to rear microphone signal with respect to angle, of a portable audio device.

FIG. 5 shows a plot example of experimental data of an energy ratio of a front microphone signal to rear microphone signal with respect to angle, of a portable audio device. FIG. 5 shows the energy ratio 27 of microphone signal 15 to that of rear microphone signal 16 plotted in db (decibels) along db axis with respect to angle axis (degrees). Ratio 27 may be based on signals 25 and 26. The angle axis of FIG. 5 may represent angle 13. In some cases it may represent angle 13'. In some cases ratio 27 represents test data or experimental data derived from signals 25 and 26, or in a setting similar to that described for signals 25 and 26. In some cases, ration 27 may be determined by hysteresis during design or use of the device and considering signals 25 and 26. It is noted that ratio 27 may apply to cases including side locations (e.g., at 90 and 270 degrees) that include all of the left side, right side, bottom and top locations of the device. Thus, Zone O may represent all of the left side, right side, bottom and top locations of the device.

According to embodiments, ratio 27 may represent data to compare to signals 15 and 16 to perform user voice location estimation or to detect the location of a user's voice with respect to angle 13 and/or angle 13'. As a result of such location or detecting, beam forming settings for the device can be adjusted or determined or selected. Ratio 27 may represent data derived from other tests or experiments than those described for signals 25 and 26.

Comparing signals 15 and 16 may include comparing them over a period of time. According to embodiments, the period of time may be between 10 and 20 milliseconds. According to embodiments, the period of time may be 10, 15 or 20 milliseconds. In some cases, the period of time may be 10 milliseconds. In some cases the period is a periodic duration that repeats, such as for the duration of the speaker mode or voice command mode.

According to embodiments, comparing signals 15 and 16 may include comparing or subtracting the energy, power, square root of power, or magnitude of volume of the microphone signal voltage of the front and rear microphones, such as over the period of time. Comparing signals 15 and 16 may include summing or averaging the power of each signal over the period of time. Comparing signals 15 and 16 may include subtracting the rear signal 16 energy or power in units of dB (decibels) from that of the front signal 15. The subtraction may be of a sum or average of the energy or power in units of dB (decibels) over the period of time. Comparing signals 15 and 16 may include delaying one of the two signals (such as using cross correlation or a similar type calculated delay) so that the voice detected (or loudest audio detected) in the two signals occur at the same time (e.g., have peaks that correspond in time) during the period of time.

Ratio 27 is shown at approximately 0 db at points 28 and 29. These points may represent angles of approximately 90° and 270° shown for signals 25 and 26. Ratio 27 is shown below 0 db for angles less than that at point 28 and greater than that at point 29. This may represent angles from 90° to 270° including 180° for signals 25 and 26. Ratio 27 is shown greater than 0 db for angles greater than 0 db for angles between points 28 and 29. This may represent angles between 270° and 90°, including 0° for signals 25 and 26.

Thus, it is possible to select or predetermine thresholds of ratio 27 for estimating (e.g., determining) whether the user's voice is location at a front, side or rear location; and for selecting whether beam forming inputs or a beam forming selection for the device should select a front, omni, or rear beam pattern. For example, threshold 30 may be predetermined so that when ratio 27 is above that threshold the ratio is in zone F, where a front beam pattern 35 is selected. It may be predetermined at a level because above this threshold experimental results show pattern 35 provides the highest quality (e.g., most accurate and loudest) user voice input data (e.g., for or as a result of beamforming). Threshold 31 may be predetermined so that when ratio 27 is below that threshold the ratio is in zone R, where a rear beam pattern 37 is selected. It may be predetermined at a level because above this threshold experimental results show pattern 37 provides the highest quality user voice input data. In some cases, when ratio 27 is below threshold 30 and above threshold 31 the ratio is in zone O, where an omni beam pattern 36 is selected. In some cases, Zone O includes all of the left side, right side, bottom and top locations of the device. Thus, a ratio in Zone O may be in any of the left side, right side, bottom or top location of the device. In some cases, predetermining thresholds 30 and 31 may also consider that between the threshold levels, experimental results show pattern 36 provides the highest quality (e.g., most accurate and loudest) user voice input data (e.g., for or as a result of beamforming).

According to other embodiments, thresholds 30 and 31 are primarily or are only predetermined so that when ratio 27 is below threshold 30 and above threshold 31 the ratio is in zone O, where an omni beam pattern 36 is selected. In these cases, predetermining thresholds 30 and 31 may consider that between the threshold levels, experimental results show pattern 36 provides the highest quality (e.g., most accurate and loudest) user voice input data (e.g., for or as a result of beamforming), regardless of whether thresholds 30 and 31 provide high quality input data for front and rear patterns 35 and 37.

In some cases, thresholds 30 and 31 may be determined by hysteresis during design or use of the device and considering signals from microphones 7 and 8. They may also consider the number of microphones, location of the microphones and types of microphones.

According to some embodiments, threshold 30 is always greater than threshold 31, such as by 5, 6, 8, 10, 15 or 20 db. According to some embodiments, threshold 30 is greater than threshold 31 by 5, 6 or 10 db. In some cases, threshold 30 is greater than threshold 31 by 6 db. In some cases, thresholds 30 and 31 are symmetrically disposed about 0 db; while in other cases, they are offset to one or the other direction (e.g., by 1 to 3 db).

FIG. 6 shows an example of front, omni and rear beam patterns of a portable audio device, such as patterns selected based on an energy ratio of a front microphone signal to rear microphone signal with respect to angle. FIG. 6 shows front beam pattern 35 oriented towards angle 0° of angle 13. This may be the preferred pattern for the situation shown in FIG. 1A and for voice 4F of FIG. 2B. FIG. 6 shows omnibeam pattern 36 oriented at all angles. In some cases, the omnibeam pattern 36 includes the front, rear, left side, right side, bottom and top direction of the device. This may be the beam pattern for the situation shown in FIG. 1B or voice 4P of FIG. 2A. FIG. 6 shows rear beam pattern 37 oriented towards angle 13 oriented towards 180°. This may be the preferred pattern for voice 4C shown in FIG. 2B. Pattern 35 may represent a situation where the output of microphone 7 is used for beam forming, but the output of microphone 8 is ignored or reduced (e.g., by 6 db). Pattern 37 may represent a situation where the output of microphone 8 is used for beam forming, but the output of microphone 7 is ignored or reduced (e.g., by 6 db). Pattern 36 may represent a situation where the output of both microphones is considered equally. Patterns 35 and 37 may represent a cardioid (e.g. standard or normal cardioid) pattern. Pattern 36 may represent an omnidirection pattern as known in the art.

In some other embodiments, rather than selecting or setting omnipattern 36 in response to detecting the voice at a side location, a more directional "side" pattern may be selected, such as a pattern that is between patterns 35 and 37. In some cases, the side pattern may represent a "V" shaped pattern perimeter around the device, with the apex of the V at the device and the center of the V opening at 90 degrees. In some cases the side patter may have a doughnut or torus type pattern with the device at the center. These cases may include beamforming using 3 or more microphones; using microphones in addition to microphones 7-8; and/or using one or microphones on a side, top or bottom surface of the device.

In some embodiments, patterns 35-37 may be described by multiplying the front microphone signal by a front weight, multiplying the rear microphone signal by a rear weight, and adding the multiplied signals together. For pattern 35 the front weight is greater than the rear weight, such as by at least 25, 30 or 40 percent. For pattern 36 the weights may be equal or within 10, 20, 25 or 30 percent of each other. For pattern 37 the rear weight is greater than the front weight, such as by at least 25, 30 or 40 percent.

In some embodiments, patterns 35-37 may provide the beam forming output for microphones 7 and 8. In other embodiments, patterns 35-37 provide the input from the microphones to be used for beam forming within each of patterns 35-37, respectively.

According to embodiments, a user voice can be located at all angles 13, 13' and side direction 20 (see FIG. 2); or for all angles theta and phi. Also, according to embodiments, device beamforming based on that location can be set for all angles 13, 13' and side direction 20; or for all angles theta and phi.

For example, the location for user's voice 4F is at a front location having angles 13 and 13' of zero degrees; and at any angle of side location direction 20 (see FIG. 2). This example may also describe where user's voice 4F is located at zero degrees theta and at any angle of phi. Based on that location, the beamforming setting may be front pattern 35.

In addition, in some embodiments, the location for a user's voice may be at angles 13 and 13' towards the front of 45 or 315 degrees (e.g., voice may be anywhere in a cone shape of angles 13 between 0 and 45 degrees); and at any angle of side direction 20 (see FIG. 2). This example may also describe where user's voice is at angles 13 and 13' less than 45 degrees theta and at any angle of phi. For example, the user's voice may be detected in a db range above (e.g., to the front of) threshold 30 shown in FIG. 5. This example may also describe where user's voice is closer to the location of voice 4F than it is to voice 4P. Based on that location, the beamforming setting may be front pattern 35.

In another example, the location for user's voice 4P is at angles 13 and 13' of 90 or 270 degrees; and at any angle of side direction 20 (see FIG. 2). This example may also describe where user's voice 4P is located at 90 degrees theta and at any angle of phi. Based on that location, the beamforming setting may be omni pattern 36.

In addition, in some embodiments, the location can be for a user's voice at angles 13 and 13' between 45 and 135 degrees (and between 225 and 315 degrees); and at any angle of side direction 20 (see FIG. 2). This example may also describe where user's voice is located between 45 and 135 degrees theta (voice may be anywhere in a cone shape of angles 13 between 45 and 135 degrees), and at any angle of phi. For example, the user's voice may be detected in a db range below (e.g., to the rear of) threshold 30, and in a db range above (e.g., to the front of) threshold 31 shown in FIG. 5. This example may also describe where user's voice is located closer to voice 4P than it is to voice 4F or 4R. Based on that location, the beamforming setting may be omni pattern 36.

In an additional example, the location for user's voice 4C is at angles 13 and 13' of 180 degrees; and at any angle of side direction 20 (see FIG. 2). This example may also describe where user's voice 4C is located at 180 degrees theta and at any angle of phi. Based on that location, the beamforming setting may be rear pattern 37.

In addition to those above, in some embodiments, the location can be for a user's voice is at angles 13 and 13' to the rear of 135 or 225 degrees (e.g., voice may be anywhere in a cone shape of angles 13 between 135 and 180 degrees); and at any angle of side direction 20 (see FIG. 2). This example may also describe where user's voice is at greater than 135 degrees theta and at any angle of phi. For example, the user's voice may be detected in a db range below (e.g., to the rear of) threshold 31 shown in FIG. 5. This example may also describe where user's voice is located closer to voice 4C than it is to voice 4P. Based on that location, the beamforming setting may be rear pattern 37.

For some embodiments, front beam pattern 35 is selected for higher positive energy ratio levels indicating angles of between 0 and 75 to 80 degrees (e.g., 0 to 75 or 80 degrees); omni pattern 36 is selected for near zero energy ratio levels indicating angles of between 75 to 80 and 110 to 115 degrees (e.g., 75 to 115 degrees, or 80 to 110 degrees); and rear beam pattern 37 is selected for higher negative energy ratio levels indicating angles of between 110 and 115 and 180 degrees (e.g., 110 or 115 to 180 degrees).

FIG. 7 is a flow diagram of an example process for performing user voice location estimation and adjusting portable device beamforming settings based on that location. FIG. 7 shows process 40 for embodiments described herein, such as for a portable electronic device (e.g., mobile phone). Some embodiments of process 40 provide a process for a portable electronic audio device to compare the audio detected at a front and rear microphone of the device to determine the angular location of a user's voice (e.g., origin of the voice), such as between front, side and rear locations with respect to the device. In some cases the voice location may be an angular location from any angles around a total spherical perimeter of the device. Based on the determination, audio beamforming input settings may be selected or adjusted by the device to provide better beamforming for the user's voice location detected. In some cases, the beamforming may be at any angular location between front, side and rear locations with respect to the device; or around the complete spherical perimeter around the device.

Process 40 starts with block 41 where a front microphone signal is generated from detection of a user's voice. Block 41 may include generating a front microphone signal from (e.g., responsive to) detection of a user's voice at a front microphone located at a front face or surface of the device (e.g., acoustic output aimed in Z+ direction through front surface 5). This may include detecting the voice over or during a period of time, such as a period during speakerphone use of the device, voice activated command use of the device, or voice activity detection (VAD) by the device.

In some cases, voice activated command use of the device includes an audio command input mode; or an intelligent personal assistant and knowledge navigator, such as application of the device that uses a natural language user interface to answer questions, make recommendations, and perform actions by delegating requests to a set of Web services (such as finding recommendations for nearby restaurants, or getting directions).

In some cases, performing VAD uses one or both microphones to detect the user's voice based on frequencies and amplitudes of audio detected by the microphone. In some cases, such VAD may include detecting the presence of the user's voice at at least one of the microphones, such as by determining that the user is speaking.

Block 41 may include generating or outputting front microphone signal 15 that is caused by (e.g., is based on, represents, is responsive to or results from) detection of user's voice 4 at a front microphone 7 located at the front (e.g., on a front surface 5) of device 1. In some cases, block 41 includes generating the front microphone signal during a period of time when the user turns or rotates the device about itself in the X-Y plane of axes AX, relative to the source of the user's voice which has remained essentially fixed. From the perspective of the device, this may cause the user's voice to move horizontally and/or vertically around a perimeter of the device, with respect to the front surface. Block 41 may include generating the front microphone signal during a period of time when the user is moving around a perimeter of the device between "speaker phone" mode and "video telephony" mode, such as where the user's mouth (e.g., the direction of received user's voice) moves vertically (and possibly laterally).

Block 41 may include detect the user's voice (e.g., volume) without detecting specific speech (e.g., words). According to embodiments, circuitry 10 may be used to perform block 41.

After block 41, process 40 continues with block 42 where a rear microphone signal is generated from detection of a user's voice. In some cases, the voice detected in block 42 is the same voice detected in block 41, during the same period of time.

Descriptions above for block 41 may apply to block 42, except that the voice is detected at microphone 8. For instance, block 42 may include generating or outputting rear microphone signal 16 that is caused by detection of user's voice 4 at a rear microphone 8 located at the rear face or surface of device 1 (e.g., acoustic output aimed in Z− direction through rear surface 6). According to embodiments, circuitry 11 may be used to perform block 42.

In some cases, block 41 and 42 may include removing frequencies of data that do not represent vibration at a frequency typical for a user's speech, such as by filtering a microphone input or using a microphone with such a physical characteristic. It can be appreciated that the order of blocks 41 and 42 can be simultaneous or reversed. Blocks 41 and 42 may include detecting sound using a microphone as described above for FIGS. 1-3.

After blocks 41 and 42, process 40 continues with block 43 where a ratio of the front and rear microphone signals is determined. Block 43 may include comparing the front microphone signal to the rear microphone signal, so that the device can determine the angular directional locations of the user during the period of time. Comparing the front microphone signal to the rear microphone signal may include calculating an energy ratio of the front microphone signal to the rear microphone signal, such as by subtracting the rear microphone signal from the front microphone signal. In some cases, block 43 includes comparing the volume, power, amplitude over time of the front microphone signal and the rear microphone signal, such as to detect a difference user's voice volume between the rear and front signals. Block 43 may include comparing the front microphone signal to the rear microphone signal as described above for FIGS. 4-5.

For example, higher positive energy ratio levels will result when the user's voice is received from angles above the front microphone (e.g., front angles near 0 degrees with respect to a +Z axis through the X, Y axis of the front surface of the device); near zero energy ratio levels will result when the user's voice is received from near sides of the device (e.g., omni angles near 90 and 270 degrees, such as along the X, Y axis); and higher negative energy ratio levels will result when the user's voice is received from closer to the rear microphone (e.g., rear angles near 180 degrees, such as corresponding to a −Z axis through the X, Y axis of the front surface of the device). According to embodiments, circuitry 12 may be used to perform block 43.

After block 43, process 40 continues with decision block 44 where it is determined whether the ratio or difference is greater than an upper threshold. In some cases, the upper threshold is threshold 30.

Block 44 may include comparing the ratio to the upper threshold, so that the device can determine whether or not the angular directional locations of the user's voice during the period of time are in the front location direction. In some cases, block 44 includes determine at least one angular directional location 13 of the user's voice during the period of time that is located closer to the front microphone than threshold 30 for the side location (e.g., Zone O). According to embodiments, circuitry 12 may be used to perform block 44.

If at block 44 it is determined that the ratio or difference is greater than an upper threshold, process 40 continues with block 45. At block 45 the front beam pattern is selected. Block 45 may include selecting front beam pattern 35 as described herein (e.g., see FIG. 6). In some cases, the front beamforming beam pattern angles will not include the rear microphone beam forming inputs. In some cases, the front beamforming beam pattern angles will include less than half of the rear microphone beam forming inputs; and all or more than half of the front microphone beam forming inputs. According to embodiments, circuitry 12 may be used to perform in block 45.

If at block 44 it is determined that the ratio or difference is less than (or equal to or less than) an upper threshold, process 40 continues with decision block 46 where it is determined whether the ratio or difference is less than a lower threshold. In some cases, the lower threshold is threshold 31.

Block 46 may include comparing the ratio to the lower threshold, so that the device can determine whether or not the angular directional locations of the user during the period of time are in the rear location direction. In some cases, block 46 includes determine at least one angular directional location 13 of the user's voice during the period of time that is located closer to the rear microphone than threshold 31 for the side direction (e.g., Zone O). According to embodiments, circuitry 12 may be used to perform block 46.

If at block 46 it is determined that the ratio or difference is less than a lower threshold, process 40 continues with block 47. At block 47 the rear beam pattern is selected. Block 47 may include selecting rear beam pattern 37 as described herein (e.g., see FIG. 6). In some cases, the rear beamforming beam pattern angles will not include the front microphone beam forming inputs. In some cases, the rear beamforming beam pattern angles will include less than half of the front microphone beam forming inputs; and all or more than half of the rear microphone beam forming inputs. According to embodiments, circuitry 12 may be used to perform block 47.

Blocks 43, 44 and 45 may include making an estimation of the location or angular direction of sound (e.g., the user's mouth or voice) with respect to microphones 7 and 8 by considering signals 15 and 16 from microphones 7 and 8, as compared to test signals 25 and 26. It can also be appreciated that comparing the front microphone signal to the rear microphone signal may include calculating an energy ratio of the front microphone signal to the rear microphone signal by various ways other than the example shown by FIG. 5, such as by subtracting the front from the rear signal, calculating a percentage ration of Front/Rear or Rear/Front, calculating means squared of each over time, and other comparisons of such types of related values, as know. According to embodiments, blocks 43, 44 and 45 may include comparing the front microphone signal to the rear microphone signal to determine at least one angular directional location of the user's voice around a spherical perimeter of the device during the period of time.

If at block 46 it is determined that the ratio or difference is greater than (or greater than or equal to) a lower threshold, process 40 continues with block 48. At block 48 the omnidirectional pattern is selected. Block 48 may include selecting omni beam pattern 36 as described herein (e.g., see FIG. 6). In some cases, the omnidirectional beam pattern angles will include the front and rear microphone beamforming inputs. According to embodiments, circuitry 12 may be used to perform block 48.

In some cases, blocks 44 and 46 include performing beamformer angular directional tuning of the front and rear microphones by changing from one to another of front beam pattern 35, omni pattern 36, and rear beam pattern 37 during the period of time. In some cases, blocks 44 and 46 include selecting the front pattern if the difference is >6 db, the rear pattern if the difference is <−6 db, and omni directional if the difference is less than 6 db and greater than −6 db. Blocks 44 and 46 may include determining the ratio and/or selecting a beam pattern as described above for FIGS. 5-6.

By using process 40 (e.g., blocks 43-48), the user's voice can be better located at any of front, side and rear locations; or any angular location of a spherical perimeter around the device (e.g., angles in spherical coordinates). For example, polar angle (theta) may correspond to the +Z direction where the +Z axis (or angle 13 or 13' shown in FIG. 2 of 0 degrees) is 0 degrees theta; and the −Z axis is 180 degrees theta. Also, azimuthal angle (phi) may correspond to angles in the X, Y plane of the front (or rear surface) where Z=0, and the range of phi corresponds with side location direction 20 (or angle 13 or 13' shown in FIG. 2 of 90 or 270 degrees). In these cases, radial distance r is not relevant.

In some cases, blocks 43-48 include selecting between a front beam, an omni beam, and a rear beam pattern for selecting beamforming input data. It can also better change beamformer angular tuning aggressiveness of the front and rear microphones during the period of time. In some cases, blocks 45, 47 and 48 also include, based on the ratio, changing beamformer angular tuning aggressiveness of the front and rear microphones during the period of time.

In some cases, changing beamformer angular tuning aggressiveness includes that if front beam is selected after determining the user location, then the rear beam signal is further attenuated using non-linear techniques. Similarly if rear beam is selected, then the front beam signal is further attenuated using non-linear techniques.

In some cases, process 40 is repeated, such as after a period of time (which may or may not be the period of time for comparing the signals). Here, process 40 may be repeated during a subsequent period of time; and blocks 44 and 46 may be repeated to determine a first angular directional location during the first period, and then a second location during the second period. Thus, during both periods, at least two angular directional locations 13 of the user may be determined during a longer period of time (e.g., including the two periods of time), such as during speaker mode, a phone call, or voice command mode.

For some embodiments, based on the calculating at least two user voice directional locations during two periods of time, beamformer angular directional tuning of the front and rear microphones can be changed between at least two of front beam pattern 35, omni pattern 36, and rear beam pattern 37 during the longer period of time.

Based on the determined locations of the user's voice, the device can provide better audio beamformer angular directional tuning inputs of the front and rear microphones (e.g., when processing microphone beamformer signals) during the period of time (e.g., to better capture the user's voice from the user's angular location, as opposed to noise at other angles). This may include selecting between a front beam, an omni beam, and a rear beam pattern for selecting beamforming input data. It can also better change beamformer angular tuning aggressiveness of the front and rear microphones during the period of time. Notably, since during the near zero energy ratio levels, the user can be at any side location (e.g., any perimeter location along the sides of the device, such as at angles near 90 and 270 degrees, or along the X, Y axis), an omni directional input can be used to combine the front and rear signals, thus providing better user voice audio input than a front or rear beam signal.

According to embodiments, selecting beamforming inputs or performing audio beamforming may include a technique in which sounds (e.g., a user's voice or speech) received from microphones 7 and 8 are combined to enable the preferential capture of sound coming from certain directions, by having microphones 7 and 8 linked to a processor (e.g., of circuitry 14). The processor can then combine the signals captured by the microphones to generate a single output to isolate a sound from background noise. In some cases, a beamformer processor receives inputs from the microphones and performs audio beamforming operations by combining the signals captured by the microphones to generate a single output to isolate a sound from background noise. For example, in delay sum beamforming each of the microphones independently receive/sense a sound and convert the sensed sound into correspond sound signals. The received sound signals are summed. The maximum output amplitude is achieved when the sound originates from a source perpendicular to the microphones. That is, when the sound source is perpendicular to the side of device 1, the sounds will all arrive at the same time at each of the microphones and are therefore highly correlated. However, if the sound source is non-perpendicular to the array, the sounds will arrive at different times and will therefore be less correlated, which will result in a lesser output amplitude. The output amplitude of various sounds makes it possible to identify background sounds that are arriving from a direction different from the direction of the sound of interest. Based on the identification of background or noise sounds, the beamformer processor performs directed reception of desired sounds.

Thus, it is possible to adjust audio beamforming settings of a portable audio device, based on or as a result of detecting the location of a user's voice using the audio signals detected at a front and rear microphone of the device, where the user's voice can be located at any front, side or rear location; and beamforming to any location within or along a total spherical perimeter or region around the device. For instance the locating and beamforming are not restricted to only certain angles, directions for quadrants of a theta and phi of spherical coordinates (or angles 13 and 13' noted above) but can be at any combination of those angles.

This may be compared to cases where a process, software and/or circuitry for user voice location estimation and adjusting portable device beamforming settings based on that location assumes that a user voice is located only either at voice 4F or voice 4C. This case fails to provide a two microphone solution for the omni directions 20 as described. Similarly if a case assumes that a user voice is located only either at voice 4F or voice 4P, then it fails to provide a two microphone solution for the rear directions 22 described. Also, if a case assumes that a user voice is located only either at voice 4C or voice 4P, then it also fails to provide a two microphone solution for the rear directions 22 described.

In some cases, the description of oriented "front" and "rear" and "side" may apply regardless of the orientation of the device, such as where they are relative to the identified surfaces of the device, regardless of its orientation in space.

In some embodiments, user voice location estimation and adjusting portable device beamforming settings based on that location may be performed by a smartphone or tablet computer housing, where the speech signal picked up by the beam former is that of the user holding the housing, and there are three possible ranges for the direction of arrival. The three ranges may be arrival from microphone 7 on the front face of the device and in particular in the device's receiver opening; arrival from microphone 8 on the rear face of the device; and arrival from both microphones 7 and 8. In some cases, the device may be a smartphone with a built-in speaker, and a speech recognition application.

Figure 8:
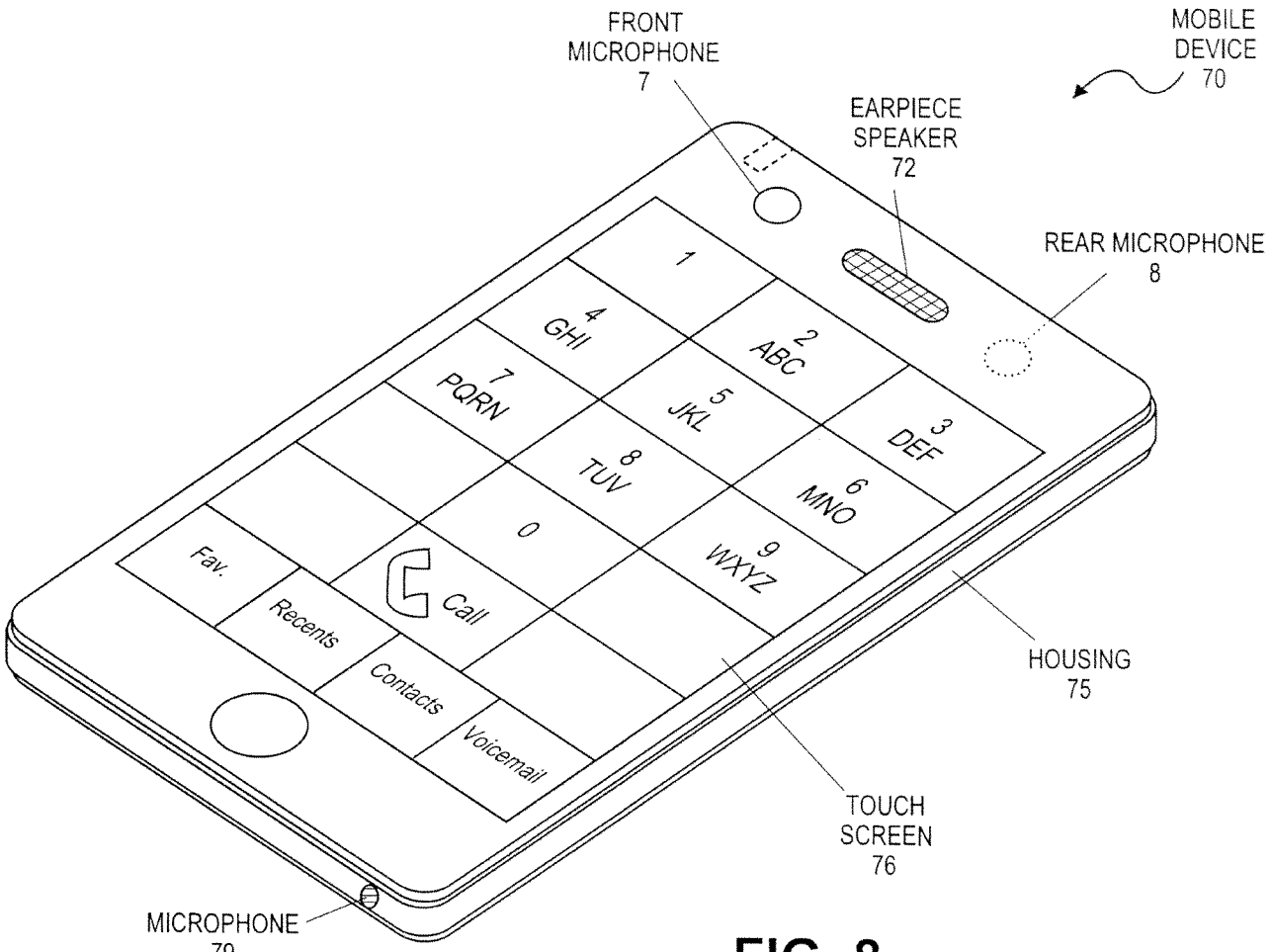
FIG. 8 shows an example mobile device for performing user voice location estimation and adjusting portable device beamforming settings based on that location.

FIG. 8 shows an example mobile device 70 for performing user voice location estimation and adjusting portable device beamforming settings based on that location. In some cases, device 70 is an embodiment of device 1. The mobile device 70 may be a personal wireless communications device (e.g., a mobile telephone) that allows two-way real-time conversations (generally referred to as calls) between a near-end user that may be holding the device 70 using speaker mode, and a far-end user. This particular example is a smart phone having an exterior housing 75 that is shaped and sized to be suitable for use as a mobile telephone handset. There may be a connection over one or more communications networks between the mobile device 70 and a counterpart device of the far-end user. Such networks may include a wireless cellular network or a wireless local area network as the first segment, and any one or more of several other types of networks such as transmission control protocol/internet protocol (TCP/IP) networks and plain old telephone system networks.

Device 70 of FIG. 8 includes housing 75, touch screen 76, microphone 79, earpiece speaker 72, and jack 5. During a telephone call, the near-end user may listen to the call in speaker mode, using earpiece speaker 72 located within the housing of the device and that is acoustically coupled to an acoustic aperture formed near the top of the housing. The near-end user's speech may be picked up by microphones 7 and 8 of device 70. The call may be conducted by establishing a connection through a wireless network, with the help of RF communications circuitry coupled to an antenna that are also integrated in the housing of the device 70.

A user may also interact with the mobile device 70 by way of a touch screen 76 that is formed in the front exterior face or surface of the housing. The touch screen may be an input and display output for the wireless telephony device. The touch screen may be a touch sensor (e.g., those used in a typical touch screen display such as found in an iPhone™ device by Apple Inc., of Cupertino Calif.). As an alternative, embodiments may use a physical keyboard may be together with a display-only screen, as used in earlier cellular phone devices. As another alternative, the housing of the mobile device 70 may have a moveable component, such as a sliding and tilting front panel, or a clamshell structure, instead of the chocolate bar type depicted.

In some cases, performing user voice location estimation may be performed by circuitry 12, and adjusting portable device beamforming settings based on that location, may be performed by circuitry 14 located in device 70. The processes, devices and functions of circuitry 12 and 14 may be implemented in hardware circuitry (e.g., transistors, logic, traces, etc), software (e.g., to be executed by one or more processors of the device), or a combination thereof to perform the processes and functions; and include the devices as described herein.

According to some embodiments, circuitry 12 and 14 (e.g., each or separately) may include or may be embodied within a computer program stored in a storage medium. Such a computer program (e.g., program instructions) may be stored in a machine (e.g. computer) readable non-transitory or non-volatile storage medium or memory, such as, a type of disk including floppy disks, optical disks, CD-ROMs, and magnetic-optical disks, read-only memories (ROMs), erasable programmable ROMs (EPROMs), electrically erasable programmable ROMs (EEPROMs), magnetic or optical cards, magnetic disk storage media, optical storage media, flash memory devices, or any type of media suitable for storing electronic instructions. The processor may be coupled to a storage medium to execute the stored instructions. The processor may also be coupled to a volatile memory (e.g., RAM) into which the instructions are loaded from the storage memory (e.g., non-volatile memory) during execution by the processor. The processor and memory(s) may be coupled to an audio codec as described herein. In some cases, the processor may perform the functions of circuitry 12 and/or 14. The processor may be controlled by the computer program (e.g., program instructions), such as those stored in the machine readable non-volatile storage medium.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although the device 1 depicted in the figures may be a portable handheld device, a telephone, a cellular telephone, a smart phone, digital media player, or a tablet computer, the audio system may alternatively be a different portable device such as a laptop computer, a hand held computer, or even a portable remote controller device (e.g., for a desktop computer or a home entertainment appliance such as a digital media receiver, media extender, media streamer, digital media hub, digital media adapter, or digital media renderer). In addition, although the concepts above are described for microphones 7 and 8, those concepts can be applied to a device having 3 or more microphones, to performing user voice location estimation, and adjusting portable device beamforming settings based on that location. The description is thus to be regarded as illustrative instead of limiting.

What is claimed is:

1. A method comprising:

a) generating a front microphone signal from detection of a user's voice at a front microphone located at a front face of a handheld portable electronic device during a period of time in which a speakerphone of the handheld portable electronic device is being used by the user;

b) generating a rear microphone signal from detection of the user's voice at a rear microphone located at a rear face of the handheld portable electronic device during the period of time;

c) comparing the front microphone signal to the rear microphone signal to determine an angular directional location of a source of the user's voice being one of a front, side or rear location, wherein the side location may be in any of a left side, a right side, a bottom or a top location of the device; and d) based on the determined front, side or rear location of the source of the user's voice, selecting beamformer angular directional tuning of the front and rear microphones to pick up the user's voice while the speaker phone is being used, wherein a)-d) is repeated while the speaker phone is being used and the handheld portable electronic device's orientation is being changed by the user, so that the determined angular directional location of the source changes between front, side and rear locations which changes the beamformer tuning of the front and rear microphones, during the speakerphone mode usage and in accordance with the changing orientation of the handheld portable electronic device.

2. The method of claim 1, wherein selecting comprises changing from a front beam pattern or a rear beam pattern to an omni beam pattern, wherein the omni beam pattern includes a front, a rear, a left side, a right side, a bottom and a top direction of the handheld portable electronic device.

3. The method of claim 1, wherein generating a front microphone signal comprises outputting a front microphone signal from the front microphone, the front microphone signal based on detection of the user's voice by the front microphone while the handheld portable electronic device is in speaker mode; and wherein generating a rear microphone signal comprises outputting a rear microphone signal from the rear microphone, the rear microphone signal based on detection of the user's voice by the rear microphone while the handheld portable electronic device is in speaker mode.

4. The method of claim 1, wherein during speakerphone usage the handheld portable electronic device is rotating with respect to the source of the user's voice.

5. The method of claim 1, wherein determining at least one angular directional location of the source of the user's voice comprises determining whether the user's mouth is angular directionally located closer to the front microphone than the rear microphone.

6. The method of claim 1, wherein comparing comprises:

calculating an energy ratio of the front microphone signal to the rear microphone signal to determine at least two angular directional locations of the source of the user's voice, wherein the two angular directional locations may be any of a front, a rear, a left side, a right side, a bottom and a top location of the handheld portable electronic device; and based on the calculating, changing beamformer angular directional tuning of the front and rear microphones.

7. The method of claim 6, wherein calculating an energy ratio comprises calculating a difference between one of volume, power, and amplitude over the period of time of the front microphone signal and the rear microphone signal to detect a difference between the front microphone signal and the rear microphone signals.

8. The method of claim 6, wherein calculating an energy ratio comprises changing beamformer angular directional tuning of the front and rear microphones between at least two of a front beam pattern, an omni beam pattern, and a rear beam pattern, wherein the omni beam pattern includes a front, a rear, a left side, a right side, a bottom and a top direction of the handheld portable electronic device.

9. The method of claim 6, wherein the front microphone has its acoustic input port located on the front face and the rear microphone has its acoustic input port located on the rear face; and wherein calculating an energy ratio comprises changing beamformer angular directional tuning aggressiveness of the front and rear microphones.

10. An apparatus to determine at least one location of a user's voice at a handheld portable electronic device during a period of time, the apparatus comprising:

a) front microphone circuitry to generate a front microphone signal from detection of a user's voice at a front microphone located at on a front surface of the handheld portable electronic device during the period of time in which a speakerphone of the handheld portable electronic device is being used by the user;

b) rear microphone circuitry to generate a rear microphone signal from detection of the user's voice at a rear microphone located on a rear surface of the handheld portable electronic device during the period of time;

c) user's voice directional location detection circuitry to compare the front microphone signal to the rear microphone signal to determine an angular directional location of a source of the user's voice being one of a front, side or rear location, wherein the side location may be in any of a left side, a right side, a bottom or a top location of the handheld portable electronic device; and d) beamformer circuitry to, based on the determined front, side or rear location of the source of the user's voice, select beamformer angular directional tuning of the front and rear microphones to pick up the user's voice while the speaker phone is being used, wherein the circuitry of a)-d) is to operate while the speaker phone is being used and the handheld portable electronic device's orientation is being changed by the user, so that the determined angular directional location of the source is to change between the front, side and rear locations which changes the beamformer tuning of the front and rear microphones, during the speakerphone usage and in accordance with the changing orientation of the handheld portable electronic device.

11. The apparatus of claim 10, further comprising beamformer circuitry to change beamformer directional tuning of the front and rear microphones based on the determined at least one angular directional location of the source of the user's voice.

12. The apparatus of claim 10, wherein the user's voice directional location detection circuitry comprises signal processing circuitry to calculate an energy ratio of the front microphone signal to the rear microphone signal to determine at least two angular directional locations of the source of the user's voice, wherein the two angular directional locations may be any of a front, a rear, a left side, a right side, a bottom or a top location of the handheld portable electronic device; and wherein the beamformer circuitry comprises beamformer angular directional tuning circuitry to change beamformer directional tuning of the front and rear microphones between at least two of a front beam pattern, an omni beam pattern, and a rear beam pattern, based on the determined at least two angular directional locations, wherein the omni beam pattern includes a front, a rear, a left side, a right side, a bottom and a top direction of the handheld portable electronic device.

13. The apparatus of claim 12, wherein calculating an energy ratio comprises calculating a difference between one of volume, power, and amplitude over the period of time of the front microphone signal and the rear microphone signal to detect a difference between the front microphone signal and the rear microphone signals.

14. The apparatus of claim 10, wherein the front microphone has its acoustic input port located on a generally planar front surface of the handheld portable electronic device, the handheld portable electronic device having a touchscreen input on the front surface and an opposing generally planar rear surface, and wherein the rear microphone has its acoustic input port located on the rear surface.

15. A non-transitory computer-readable medium storing data and instructions to cause a programmable processor to perform operations comprising:

a) generating a front microphone signal from detection of a user's voice at a front microphone located at a front face of a handheld portable electronic device during a period of time in which a speakerphone of the handheld portable electronic device is being used by the user;

b) generating a rear microphone signal from detection of the user's voice at a rear microphone located at a rear face of the handheld portable electronic device during the period of time;

c) comparing the front microphone signal to the rear microphone signal to determine an angular directional location of a source of the user's voice being one of a front, side or rear location, wherein the side location may be in any of a left side, a right side, a bottom or a top location of the handheld portable electronic device; and d) based on the determined front, side or rear location of the source of the user's voice, selecting beamformer angular directional tuning of the front and rear microphones to pick up the user's voice while the speaker phone is being used, wherein a)-d) is repeated while the speaker phone is being used and the handheld portable electronic device's orientation is being changed by the user, so that the determined angular directional location of the source changes between front, side and rear locations which changes the beamformer tuning of the front and rear microphones, during the speakerphone usage and in accordance with the changing orientation of the handheld portable electronic device.

16. The medium of claim 15, wherein selecting comprises changing from a front beam pattern or a rear beam pattern to an omni beam pattern, wherein the omni beam pattern includes a front, a rear, a left side, a right side, a bottom and a top direction of the handheld portable electronic device.

17. The medium of claim 15, wherein generating a front microphone signal comprises outputting a front microphone signal from the front microphone, the front microphone signal based on detection of the user's voice by the front microphone while the handheld portable electronic device is in speaker mode; and wherein generating a rear microphone signal comprises outputting a rear microphone signal from the rear microphone, the rear microphone signal based on detection of the user's voice by the rear microphone while the handheld portable electronic device is in speaker mode.

18. The medium of claim 17, wherein during speakerphone usage the handheld portable electronic device is rotating with respect to the source of the user's voice.

19. The medium of claim 15, wherein operations further comprise:

calculating an energy ratio of the front microphone signal to the rear microphone signal to determine at least two angular directional locations of the user's voice, wherein the two angular directional locations may be any of a front, a rear, a left side, a right side, a bottom and a top location of the handheld portable electronic device; and based on the calculating, changing beamformer angular directional tuning of the front and rear microphones.

* * * * *